US012305479B2

(12) United States Patent
McChesney et al.

(10) Patent No.: US 12,305,479 B2
(45) Date of Patent: May 20, 2025

(54) IMPULSE TURBINE USED TO MEASURE PRODUCTION FLUID PROPERTIES DOWNHOLE AND DETECT WATER BREAKTHROUGH

(71) Applicant: Halliburton Energy Services, Inc., Houston, TX (US)

(72) Inventors: Ryan W. McChesney, Carrollton, TX (US); Stephen Michael Greci, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 119 days.

(21) Appl. No.: 18/202,196

(22) Filed: May 25, 2023

(65) Prior Publication Data

US 2024/0392650 A1 Nov. 28, 2024

(51) Int. Cl.

| | |
|---|---|
| ***E21B 34/08*** | (2006.01) |
| ***E21B 41/00*** | (2006.01) |
| ***E21B 43/12*** | (2006.01) |
| ***E21B 47/10*** | (2012.01) |

(52) U.S. Cl.

CPC ..... *E21B 34/08* (2013.01); *E21B 41/0085* (2013.01); *E21B 43/12* (2013.01); *E21B 47/10* (2013.01)

(58) Field of Classification Search

CPC ..... E21B 34/08; E21B 41/0085; E21B 43/12; E21B 47/10; E21B 34/06

See application file for complete search history.

(56) References Cited

U.S. PATENT DOCUMENTS

| | | | | |
|---|---|---|---|---|
| 8,262,909 | B2 | 9/2012 | Angelescu et al. | |
| 9,377,332 | B2 | 6/2016 | Carapelli | |
| 9,879,506 | B2 | 1/2018 | Frosell et al. | |
| 10,494,904 | B2 | 12/2019 | Frosell et al. | |
| 10,989,024 | B2 | 4/2021 | Fripp et al. | |
| 11,105,183 | B2 | 8/2021 | Frosell et al. | |
| 11,493,145 | B2 | 11/2022 | Fripp et al. | |
| 11,543,049 | B2 | 1/2023 | Greci et al. | |
| 2011/0297384 | A1 | 12/2011 | Fripp et al. | |
| 2014/0260674 | A1* | 9/2014 | Carapelli | G01F 1/10 73/861.79 |
| 2015/0021015 | A1 | 1/2015 | Xiao | |
| 2017/0306725 | A1 | 10/2017 | Hunter | |

(Continued)

OTHER PUBLICATIONS

International Search Report and Written Opinion for International Patent Application No. PCT/US2023/026062 dated Feb. 14, 2024. PDF file. 10 pages.

*Primary Examiner* — Caroline N Butcher
(74) *Attorney, Agent, or Firm* — Scott Richardson; C. Tumey Law Group PLLC

(57) ABSTRACT

A transition in the fluid composition of a production fluid is detectable downhole based on a rotational response of a rotor through which flow is directed. The transition is detectable, at least in part, based on different rotational speeds of different fluid compositions. The transition may be detected or confirmed by an anomaly in the rotational response (e.g., a temporary dip) due to an emulsion between two or more fluid components. The non-Newtonian behavior of the emulsion makes its presence easily detectable in a rotor chamber. These principles may enable a rotor to act not only as a power source but as a water cut sensor.

19 Claims, 5 Drawing Sheets

(56) References Cited

U.S. PATENT DOCUMENTS

| | | | | |
|---|---|---|---|---|
| 2019/0010783 | A1* | 1/2019 | Frosell | E21B 41/0085 |
| 2019/0055814 | A1 | 2/2019 | Frosell et al. | |
| 2020/0040676 | A1 | 2/2020 | Greci et al. | |

* cited by examiner

IMPULSE TURBINE USED TO MEASURE PRODUCTION FLUID PROPERTIES DOWNHOLE AND DETECT WATER BREAKTHROUGH

BACKGROUND

Production tubing and other equipment may be installed in a wellbore of a well system (e.g., an oil or gas well) for communicating fluid in the wellbore to the well surface. The resulting fluid at the well surface is referred to as production fluid. Production fluid may include a mix of different fluid components, such as oil, water, and gas, and the ratio of the fluid components in the production fluid may change over time. This may make it challenging for a well operator to control which types of fluid components are produced from the wellbore. For example, it may be challenging for a well operator to preferentially produce hydrocarbons from the wellbore, while reducing or eliminating water production.

BRIEF DESCRIPTION OF THE DRAWINGS

These drawings illustrate certain aspects of some of the embodiments of the present disclosure and should not be used to limit or define the method.

DETAILED DESCRIPTION

Figure 1:
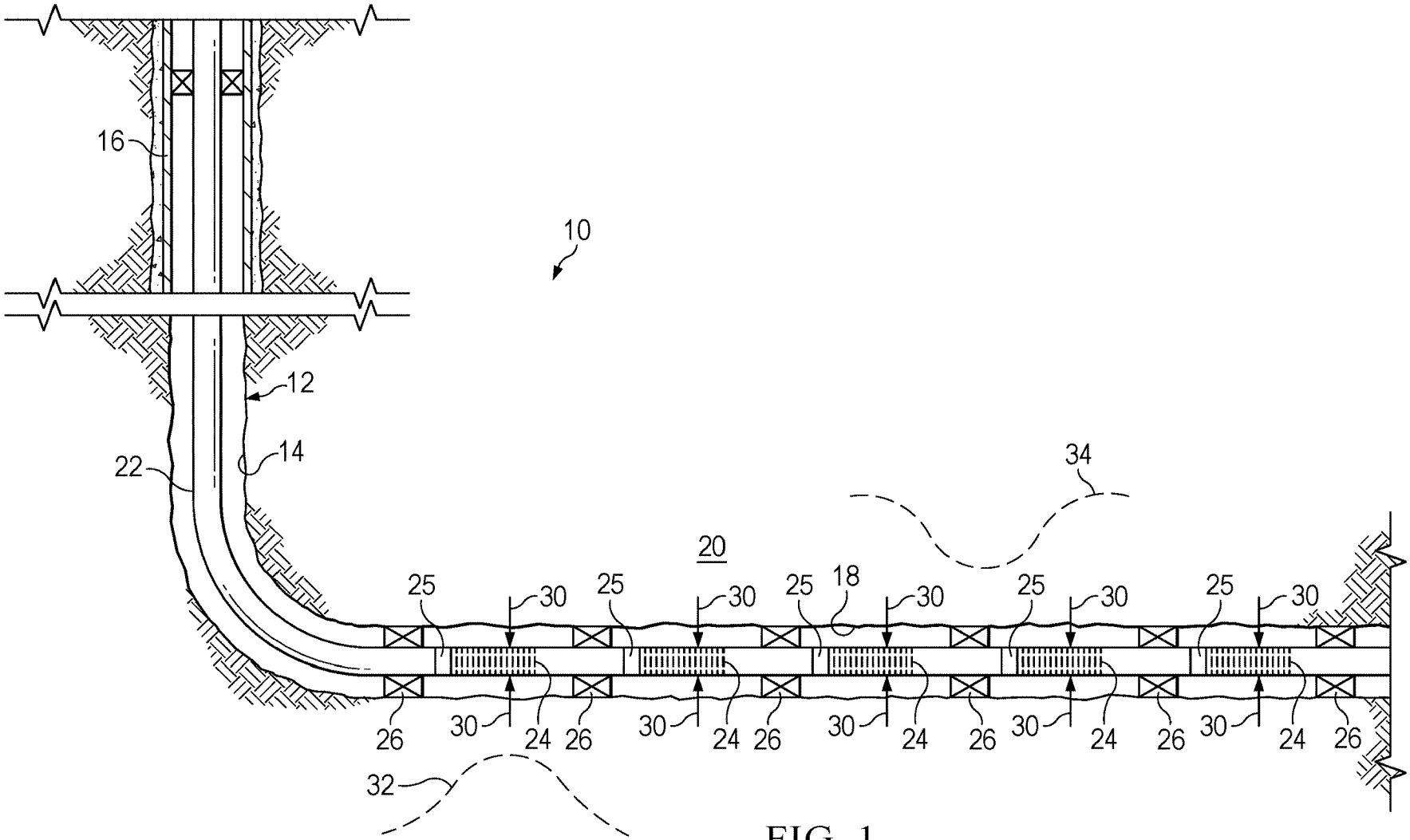
FIG. 1 illustrates a schematic view of a well system including a variable flow resistance system in accordance with one or more embodiments of the present disclosure.

A method and a system for a downhole flow control device is disclosed for controlling the production of formation fluids from a subterranean formation (i.e., formation). The formation fluids typically comprise multiple fluids, such as oil, natural gas, water, carbon dioxide, hydrogen sulfide, and so forth, which may be produced in varying amounts and proportions based on changing downhole conditions. A produced formation fluid (i.e., a production fluid), may therefore comprise a time-varying composition of these fluid components. As such, the composition of the production fluid may change over time, either by changes in which fluid components are being produced and/or changes in the proportion of the fluid components being produced. For example, during slug flow, the composition of the production fluid may temporarily change from mostly oil (with perhaps a small amount of water and/or other fluid components) to mostly water (with perhaps a small amount of oil and/or other fluid components).

In some examples, a flow control device (e.g., a downhole flow control device) may be able to detect changes in the fluid composition of a production fluid based on a variation in the rotational speed of a rotor through which formation fluids may be produced. In some examples, the flow control device may be an inflow control device. The inflow control device may be disposed in the wellbore to receive production fluid from an annular portion of a wellbore and relay or restrict flow of the production fluid to a production conduit. The production conduit may relay the production fluid to a surface or subsea location. The rotational speed of the rotor may be responsive to changes in the fluid composition of the production fluid. The variation in the rotational speed (measurable, e.g., as RPMs) speed of the rotor as the fluid composition changes may be due in part to different properties (e.g., density and/or viscosity) of the fluid components. In some examples, the rotor may be a turbine and the variation in rotational speed may result in a variance in output voltage.

A Newtonian fluid may be a fluid which maintains a consistent viscosity regardless of the shear rate applied to the fluid. In some examples, water and certain molecular weights of hydrocarbons, may behave as Newtonian fluids. For example, light-hydrocarbon oils may behave as Newtonian fluids in that, for a given pressure and temperature, the fluids exhibit a constant viscosity regardless of shear rate. In other examples, hydrocarbons of a certain molecular weight may behave as non-Newtonian fluids. For example, for a given pressure and temperature, the viscosity of a non-Newtonian fluid may either increase with increased shear rate (e.g., shear thickening) or decrease with increased shear rate (e.g., shear thinning). Additionally, for a constant shear rate, the viscosity of hydrocarbons, such as crude oil (i.e., liquid hydrocarbons or oil) may vary as a function of molecular weight and temperature. In some examples, there may be a direct correlation between the viscosity and the specific gravity of hydrocarbons (i.e., oil) where the viscosity at a given temperature increases with an increase in specific gravity. In some examples, the difference in viscosities between a single-component fluid comprising water and a single-component fluid comprising liquid hydrocarbons may result in a variation in rotational speed when the fluids flow past, and rotate a rotor. In some examples, a mixture of oil and water may form an emulsion which may exhibit non-Newtonian behavior. In some examples, the variation in rotational speed may also be partially attributable to an emulsion phase of two fluid components (e.g., oil and water) that may occur as the production fluid flow transitions from flow of one fluid composition (e.g., mostly oil) to another fluid composition (e.g., mostly water). An aspect of this disclosure extends from observations that the rotational speed during an emulsion of two fluid components is not necessarily some intermediate value between the rotational speed due to pure flow of one of the fluid components and pure flow of the other fluid component. For example, the emulsion phase may result in a temporary dip (e.g., a significant dip) in the rotational speed that is below that of the rotational speed associated with the flow of each component taken separately. In further examples, the temporary dip (e.g., a significant dip) in the rotational speed that may be associated with the emulsion phase may be below the rotational speed of associated with a non-emulsion phase of the production fluid including at least two fluid components (e.g., oil and water). Thus, changes in the fluid composition may be detected not only by changes in rotational speed as the fluid composition transitions but also detected and/or confirmed by identifiable rotational phenomena (e.g., a significant dip) resulting from an emulsion phase of two or more fluid components of the production fluid. In some examples, the difference in viscosity between a first fluid component (e.g., oil) and a second fluid component (e.g., water) may not be significant enough to detect the transition in the fluid composition without the aid of an emulsion (e.g., transient, high viscosity phase). In other examples, the different in the viscosity of the first fluid component and the second fluid component may be significant enough to identify the transition in fluid composition, and the detection of the emulsion phase may be used as confirmation.

FIG. 1 shows a well system 10 that can embody principles of the present disclosure. As depicted in FIG. 1, a wellbore 12 has a generally vertical uncased section 14 extending downwardly from casing 16, as well as a generally horizontal uncased section 18 extending through a subterranean formation 20. A production fluid 30 may be extracted from the subterranean formation 20. For example, the subterranean formation 20 may include a pore space which may further contain fluid components such as at least hydrocarbons (e.g., oil and gas) and formation water. The fluid composition of the production fluid 30 may be determined as a volumetric ratio of the fluid components present within a given volume production fluid 30. In some examples, the volumetric ratio of the various fluid components within the given volume of production fluid 30 may be referred to as a fluid cut. For example, the volumetric ratio of production water in a given volume of production fluid (e.g., the volume of produced water relative to the total volume of produced fluid for a given time interval) may be referred to as a water cut. Likewise, the volumetric ratio of oil in a given volume of production fluid (e.g., the volume of produced oil relative to the total volume of produced fluid for a given time interval) may be referred to as an oil cut. While any interval of time may be used to calculate a fluid cut (e.g., water cut and/or oil cut), in some examples, a 24-hour period may be used as the time interval for determining the fluid cuts on a given well. Furthermore, the fluid cuts may be calculated hour to hour, day to day, month to month, year over year, and so forth in accordance with the produced fluid volumes which fall in the aforementioned time intervals. In some examples, the fluid cuts (e.g., water cut and oil cut) may be monitored, tracked and recorded over a duration of time ranging from hours to years.

In some examples, portions of the subterranean formation 20 may be grouped according to the types and volumes of fluid components (e.g., oil, water, and gas) contained within a given volume of rock (e.g., a volume of rock included in the subterranean formation 20). The volumetric ratio of one fluid component relative to the total volume of the pore space within the given volume of rock may be referred to as a saturation. For example, an oil saturation for a given volume of rock may be the volume of oil contained within the pore space of the given rock volume relative to the total volume of the pore space in the given rock volume. Likewise, gas saturations and water saturations may also be determined. The foregoing saturations may be used to categorize different sections of the subterranean formation 20.

In some examples, a given pore space volume may contain both hydrocarbons (e.g., oil and gas) and formation water, while in other examples the only fluid component present may be formation water. A determination of the fluid components present within a pore space as a percentage by volume (e.g., fluid saturation) may be used as a guideline for identifying a target production zone. For example, a portion of the subterranean formation with a relatively high oil saturation may be a candidate for a target production zone. In some examples, a portion of the subterranean formation with relatively high oil saturation may be located above or below a portion of the formation with relatively high water saturation. In further examples, the formation water located in the relatively high water saturation zone may be fluidically connected to the portion of the subterranean formation with a relatively high oil saturation. As such, formation water from the high water saturation area may be produced as the formation fluids are depleted. Likewise, a portion of the subterranean formation with relatively high gas saturation may be located above or below a portion of the formation with relatively high water saturation or oil saturation. In further examples, the formation gas located in the relatively high gas saturation zone may be fluidically connected to a portion of the subterranean formation with a relatively high oil or water saturation. In other examples, lighter hydrocarbons which may exist in the gas phase at ambient conditions may be entrained in the oil phase at formation conditions (e.g., pressure and temperature). In some examples, hydrocarbons may transition between in the oil phase and/or the gas phase depending on the production history or the well (e.g., depletion of pressure in the subterranean formation).

A production conduit 22 (such as a production tubing string or a casing) may be installed in the wellbore 12. Interconnected in the production conduit 22 may be multiple well screens 24, flow control system 25, and packers 26. The packers 26 seal off an annulus 28 formed radially between the production conduit 22 and the wellbore section 18. In this manner, the production fluid 30 may be produced from multiple intervals or zones of the subterranean formation 20 via isolated portions of the annulus 28 between adjacent pairs of the packers 26. Formation fluids typically comprise multiple fluids, such as oil, natural gas, water, carbon dioxide, and so forth, which may be produced in varying amounts and proportions based on changing downhole conditions. The production fluid 30, may therefore comprise a time-varying composition of these fluid components.

In some examples, the flow regime and fluid composition of the production fluid 30 may fluctuate as a function of time, pressure regime, and operational parameters. For example, a wellbore 12 disposed within the subterranean formation 20 may fluctuate between preferentially producing one fluid component to preferentially producing another fluid component in a process which may be referred to as "slugging." In other examples, slug flow may include at least two distinct fluid components that are not mixed together when they enter a production inlet, such as a flow control device or a casing perforation. As such, when formation fluids are produced as a product of slugging, the volumetric ratio of the fluids in the production fluid 30 may vary dramatically such that certain portions of the production fluid 30 may predominantly comprise one fluid component and then subsequently comprise a different fluid component. In some examples, slugging may occur due to separation which naturally occurs in the annular portion of the well. In other examples slugging may occur at least in part from fluid unloading from troughs (e.g., lower portions) in a horizontal wellbore. In further examples, water may tend to gather in the troughs of a lateral section of a horizontal wellbore due to gravity separation. This change in the volumetric ratio of the fluids in the production fluid 30 may be detectable from changes in a rotational speed of a rotor disposed in the wellbore. For example, for a given volumetric flow rate, a change in rotational speed may be interpreted as a change in the composition of the flow. Since factors other than composition might also affect the rotational speed, a predetermined threshold may be identified above which the change is likely attributable to a significant change in composition indicative of slugging. The threshold may be determined empirically, such as during a calibration process or by computer modeling. In some examples, the threshold may include a threshold percentage change.

In some examples, a phase change of the production fluid 30 may form when a transition of the volumetric ratio of the two or more fluid components of the production fluid 30 occurs. The phase change may include the formation of an emulsion. The transition in the fluid composition of the production fluid may at least partially contribute to the phase change (e.g., formation of an emulsion). For example, an emulsion may form between two fluid components when the production fluid 30 transitions from predominantly producing the first fluid component to predominantly producing the second fluid component. In further examples, when the production fluid 30 transitions from predominantly producing oil to predominantly producing water, the mixture of the two fluid components during the transition may result in an emulsion. Additionally, an emulsion may form when the production fluid 30 transitions from predominantly producing water to predominantly producing oil. In some examples, the development of an oil-and-water emulsion in the production fluid 30 may intermittently result from slugging. The rotational response (e.g., change in rotational speed of a rotor or turbine) due to slugging and resultant emulsion phase may be more pronounced or distinctive than just a change in rotational speed due to different compositions. For example, the rotational response (e.g., change in rotational speed of a rotor or turbine) may include a temporary dip below the respective rotational speeds due to flow of the fluid components if taken separately. The rotational response may also be temporary and relatively short-lived, which may be used to further distinguish an emulsion phase due to slugging. Since the emulsion may be formed at a flow transition between the fluid compositions, the production of the emulsion phase may not extend beyond a certain threshold of time. For example, the emulsion phase may be present for a duration less than or equal to 5 minutes. In some examples, the emulsion phase may be present for a duration less than or equal to 4 minutes, less than or equal to 3 minutes, less than or equal to 2 minutes, less than or equal to 1 minute, less than or equal to 30 seconds, or any combination thereof.

In addition to the foregoing, oil-and-water emulsions may form in the production fluid 30 as the formation depletes and the formation saturations become formation water dominant. In other examples, injected water may increase the ratio of produced water included in the production fluid 30 which may also create an oil-and-water emulsion. Since the emulsion may be formed at a transition point between the fluid compositions, the production of the emulsion phase may not extend beyond a certain threshold of time. For example, the emulsion phase may be present for less than or equal to 5 minutes. In some examples, the emulsion phase may be present for a duration less than or equal to 4 minutes, less than or equal to 3 minutes, less than or equal to 2 minutes, less than or equal to 1 minute, less than or equal to 30 seconds, or any combination thereof. Positioned between each adjacent pair of the packers 26, a well screen 24 and the flow control system 25 are interconnected in the production conduit 22. The well screen 24 filters the production fluid 30 flowing into the production conduit 22 from the annulus 28. The flow control system 25 variably restricts flow of the production fluid 30 into the production conduit 22, based on certain characteristics of the production fluids 30.

The well system 10 illustrated in the drawings and described herein is merely one example of a wide variety of well systems in which the principles of this disclosure can be utilized. The well system 10 is simplified in certain aspects and is not to scale. Although a single vertical section and horizontal section are shown for discussion purposes, the wellbore 12 may follow any suitable trajectory, to include any number of horizontal or deviated wellbore sections. Any portion may be cased or open hole. The arrangement of the well screen 24 and packers 26 is also exemplary. Any number, arrangement and/or combination of these components may be used. It should be clearly understood, therefore, that this disclosure describes how to make and use certain examples, but the principles of the disclosure are not limited to any details of those examples. Instead, those principles can be applied to a variety of other examples using the knowledge obtained from this disclosure.

As formation fluids are produced, both the formation fluids and the formation pressure (e.g., pressure in the pore space of the subterranean formation) may deplete. Over time, depletion of the formation fluids may result in a change in formation fluid saturations. Additionally, the pressure depletion may reduce the rate of production of the formation fluids. In some examples, aqueous solutions may be injected into a portion of the subterranean formation 20 in order to maintain or increase the formation pressure within the subterranean formation 20. In further examples, the depth at which the aqueous fluids are injected may align with the depth from which fluids are being produced from the subterranean formation 20. In other examples, the aqueous fluids may be injected above or below the depth at which the production fluids are being withdrawn from the subterranean formation 20. In addition to bolstering the pressure of the subterranean formation 20, injecting the aqueous fluids may act to maintain or increase the rate at which formation fluids are produced. However, this may result in a change to the saturations of the various fluid components within the subterranean formation 20. Additionally, the injected aqueous solutions may comingle with the formation fluids and eventually be produced in conjunction with the formation fluids. In general, the amount of produced water (e.g., formation water, injected water, or combinations thereof) present within the production fluids 30 may increase over time. As such, for subterranean formations 20 which include injection operations, a given pore space volume may contain both hydrocarbons (e.g., oil and gas), formation water, and injected water. In other examples, the only fluid components present may be water (e.g., formation water, injected water, or combination thereof). As such, It is not necessary for production fluid 30 to exclusively include naturally occurring formation fluids disposed in the subterranean formation 20. In some examples, production fluids 30 could be injected into the subterranean formation 20 by the producing well or an offset well. In some examples, injected fluids may be injected into a fluidically connected portion of a separate subterranean formation and migrate to subterranean formation 20 after which the injected fluids may be included in the production fluids 30. Therefore, fluids could be both injected into and produced from a formation, etc.

It is not necessary for any flow control system 25 to be used with a well screen 24. For example, in injection operations, the injected fluid could be flowed through the flow control system 25, without also flowing through a well screen 24.

It will be appreciated by those skilled in the art that it would be beneficial to be able to regulate flow of the production fluid 30 into the production conduit 22 from each zone of the subterranean formation 20, for example, to prevent water coning 32 or gas coning 34 in the formation. Other uses for flow regulation in a well include, but are not limited to, balancing production from multiple zones and maximizing the production of certain fluid components of the production fluid.

Examples of the flow control systems 25 described more fully below can provide these benefits by increasing resistance to flow if a fluid velocity increases beyond a selected level (e.g., to thereby balance flow among zones, prevent water or gas coning, etc.), or increasing resistance to flow if a fluid viscosity decreases below a selected level (e.g., to thereby restrict flow of certain fluid components, such as water, in an oil producing well).

Note that, at downhole temperatures and pressures, hydrocarbon gas can actually be completely or partially in the liquid phase. Thus, it should be understood that when the term "gas" is used herein, supercritical, liquid and/or gaseous phases are included within the scope of that term.

Figure 2:
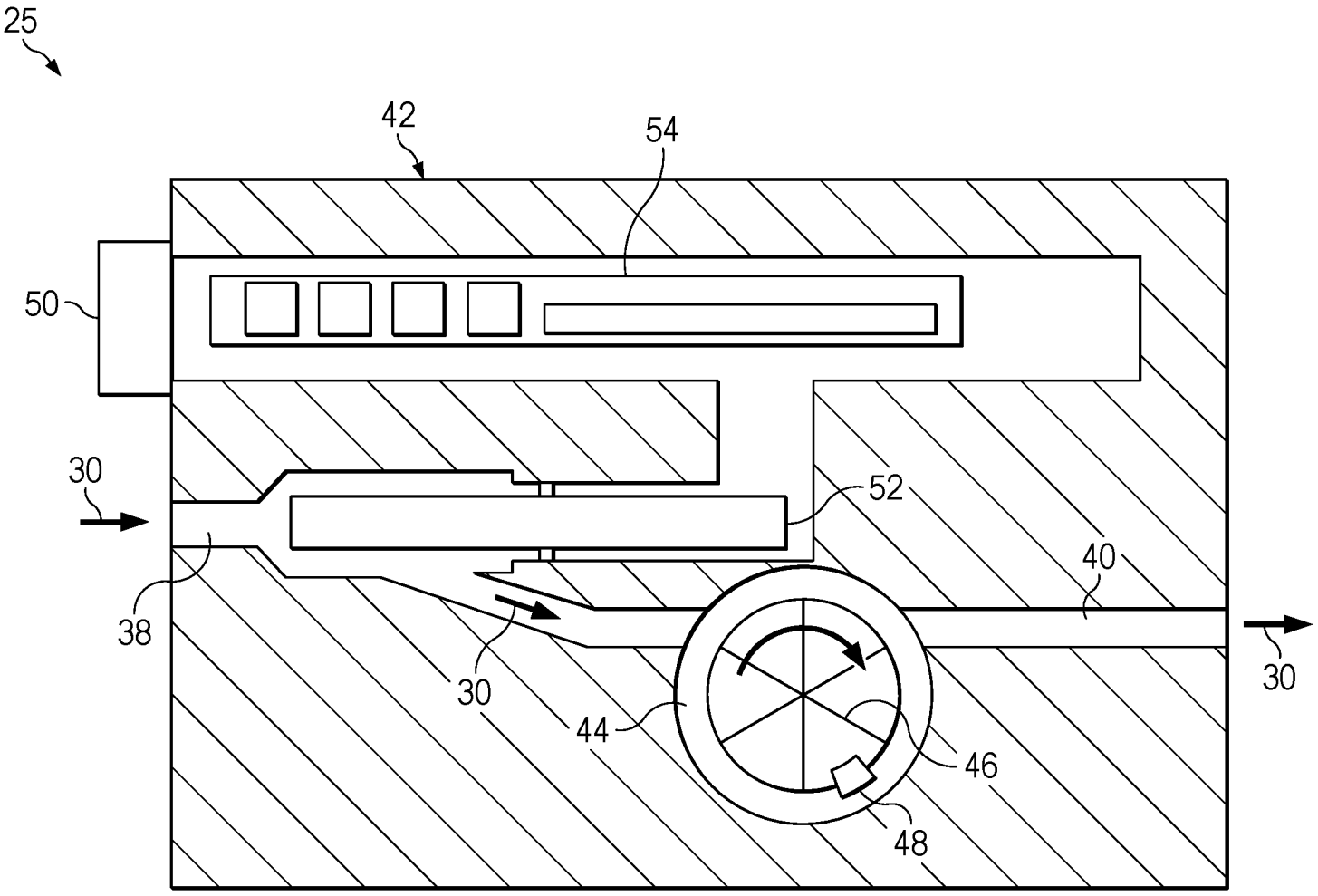
FIG. 2 illustrates a schematic view of a variable flow resistance system in accordance with one or more embodiments of the present disclosure.

FIG. 2 is a schematic view of a flow control system 25 according to an example configuration. In this example, the production fluid 30 may be filtered by a well screen (24 in FIG. 1) and may then flow into a first flow path 38 (e.g., an inlet flow path) of the flow control system 25. The production fluid 30 may include any number of fluid components. Flow of the production fluid 30 through the flow control system 25 may resisted based on one or more characteristics (e.g., viscosity, etc.) of the fluid. The production fluid 30 may then be discharged from the flow control system 25 to an interior of the production conduit 22 via a second flow path 40 (e.g., an outlet flow path). As used herein, the first flow path 38 and the second flow path 40 may be generally described and function as an inlet flow path and an outlet flow path, respectively.

The flow control system 25 is depicted in simplified form in FIG. 2, but can include other features, e.g., various passages and devices for performing various functions, as described more fully below. In some examples, the flow control system 25 may partially extend circumferentially about the production conduit 22, or the flow control system 25 may be formed in a wall of a tubular structure interconnected as part of the tubular string.

In other examples, the flow control system 25 may not extend circumferentially about a tubular string or be formed in a wall of a tubular structure. For example, the flow control system 25 could be formed in a flat structure, etc. The flow control system 25 could be in a separate housing 42 that may be attached to the production conduit 22, or it could be oriented so that the axis of the second flow path 40 may be parallel to the axis of the tubular string. Any orientation or configuration of the flow control system 25 may be used in keeping with the principles of this disclosure.

Referring still to FIG. 2, the flow control system 25 includes the first flow path 38 to receive fluid into the flow control system 25 and a second flow path 40 to send fluid out of the flow control system 25. When fluid exits the flow control system 25, the fluid may, for example, then enter into a production conduit (e.g., production conduit 22 of FIG. 1) after which it may be relayed to a surface or a subsea location. In some examples, the fluid may enter into the interior of a tool body that may be used in conjunction with the flow control system 25. The flow control system 25 may further include a housing 42, a rotor chamber 44, a rotor 46, and a sensor 48. The housing 42 may be positionable in a well. The rotor 46 may be rotatably disposed within the rotor chamber 44, which may further be disposed in the housing 42. The rotor 46 may be rotatable in response to the flow of a production fluid through the rotor chamber 44. The sensor 48 may be disposed in the rotor chamber 44 to sense a rotational speed of the rotor 46. In some examples, the rotor chamber 44 may include features to induce turbulence in the fluid flow or features to streamline the fluid flow. The aforementioned features (e.g., to induce turbulence or promote streamlined flow) may promote or delay the formation of emulsions depending on the production goals or fluid properties of a particular well.

The flow control system 25 disposed in a subterranean portion (e.g., downhole portion) of a wellbore (e.g., wellbore 12 in FIG. 1) may be able to identify transitions in a fluid composition of the production fluid 30. In some examples, the flow control system 25 may include a rotor disposed in a rotor chamber. In the course of production, the production fluid 30 may travel from the subterranean formation (e.g., subterranean formation 20 in FIG. 1) to the annular space of a well (e.g., annulus 28 in FIG. 1), after which it may pass through the rotor chamber 44 to progress into a conduit which may relay the production fluid 30 to a surface or subsea location. As the production fluid 30 travels through the rotor chamber 44, it may rotate the rotor 46 housed therein. The rotor 46 may exhibit different rotational speeds in response to changes in the fluid composition of the production fluid 30 which passes through the rotor chamber 44. The sensor 48 may measure the changes in rotational speed of the rotor 46 in response to varying viscosities of the production fluid 30. In some examples, sensor 48, which measures changes in rotational speed, may function as a water cut sensor. For example, if a well is producing under slug flow conditions, an average water cut may be estimated based on the duration of time (e.g., which may be associated with a volume) that the measured rotor speed is associated with the production of water. Likewise, when producing under slugging conditions, an average oil cut may be estimated based on the duration of time (e.g., which may be associated with a volume) that the measured rotor speed is associated with the production of oil.

In addition to the sensor 48 for sensing the rotational speed of the rotor 46, the flow control system may include other sensor types 50 which may measure other fluid properties of the production fluid. For example, more than one sensor and/or more than one actuator may be used in accordance with the present disclosure. For example, in addition to the sensor 48, which senses the rotational speed of the rotor 46, there may be other sensor types 50 disposed in first flow path 38 or within the housing 42 of the flow control system 25. In such an embodiment, if using multiple sensors or actuators, the sensors and actuators used may be different from each other and/or may have different thresholds or tolerances than each other. For example, multiple different sensors (e.g., other sensor types 50) may be used to measure different properties of the fluid, and multiple different actuators may be used to control the inflow rate of the fluid using different techniques or at different thresholds. In some examples, the additional sensors may include a resistivity sensor, a conductivity sensor, a capacitive sensor, an inductive sensor, an acoustic sensor, a nuclear sensor, a temperature sensor, a flow sensor (e.g., flow rate sensor), and/or any other type of sensor known in the art.

In some examples, the flow control system 25, may include a flow control device such as an inflow control device. In further examples, the flow control system 25 and inflow control device may further comprise a flow regulator 52. In some examples, the flow regulator 52 may be adjustable to provide resistance to flow of the production fluid (e.g., production fluid 30 of FIG. 1). In further examples, the flow regulator 52 may partially or fully restrict production fluid (e.g., production fluid 30 of FIG. 1) from entering the production conduit (e.g., production conduit 22 of FIG. 1). In some examples the flow regulator 52 may be an actuator or a valve. In further examples, the flow regulator may be an electronically controlled actuator or an electronically controlled valve. The sensor 48 which senses the rotational speed of the rotor may be positioned within the rotor chamber 44 near or adjacent the rotor. The flow regulator 52 may control or adjust an inflow rate of fluid received into the flow control system 25 and the first flow path 38 based upon the rotational speed or a variation in the rotational speed of the rotor 46 as measured by the sensor 48. For example, if the flow regulator is an actuator, it may be positioned or included within the flow control system 25 to extend into and retract from the fluid flow path extending and formed through the flow control system 25. To increase the inflow rate of the fluid, the flow regulator 52 may retract to enable more fluid to flow through the fluid flow path of the flow control system 25. To decrease the inflow rate of the fluid, the flow regulator 52 may extend to restrict the fluid flow through the fluid flow path of the flow control system 25. Further, in one or more embodiments, the flow regulator 52 may be used to fully stop or inhibit the fluid flow through the fluid flow path of the flow control system 25. As such, the flow regulator 52 may be adjustable to provide a flow resistance to the production fluids 30. In some examples, if the flow control system 25 is turned or powered off, the flow regulator 52 may fully extend to prevent fluid flow through the fluid flow path of the flow control system 25.

Further, if the flow regulator 52 is an actuator, then it may include a mechanical actuator (e.g., a screw assembly), an electrical actuator (e.g., piezoelectric actuator, electric motor), a hydraulic actuator (e.g., hydraulic cylinder and pump, hydraulic pump), a pneumatic actuator, and/or any other type of actuator known in the art. For example, the flow regulator 52 may include a linear or axially driven actuator, in which the flow regulator 52 interacts with an orifice included in the first flow path 38 to control the inflow rate of the fluid. As such, the flow regulator 52 may be adjustable to provide a flow resistance to the production fluids 30.

In some examples, the viscosity of the produced fluid may impact the rotational speed of the rotor 46, where the rotor 46 is rotatable in response to the flow of a production fluid 30. For example, the rotor 46 may rotate at one rotational speed when the fluid composition of the produced fluid passing through the rotor chamber 44 predominately consists of oil. Likewise, the rotor 46 may exhibit a different rotational speed when the fluid composition of the produced fluid is predominantly gas or produced water (e.g., formation water, injected water, or a combination thereof). Additionally, the rotational speed of the rotor 46 may exhibit a dip in rotational speed if an emulsion enters or is formed within the rotor chamber 44. For example, the emulsion formed from the production fluid 30, may exhibit an increased viscosity relative to a non-emulsified production fluid 30. The increased viscosity of the emulsion may cause a reduction in rotational speed of the rotor 46 as sensed by the sensor 48. As described in the forgoing, a transition in the fluid composition of the production fluid 30 may at least partially contribute to a phase change, including the formation of an emulsion. For example, the emulsion may form in response to an increased volumetric ratio of produced water within the produced fluid. Alternatively, the emulsion may form in response to an increased volumetric ratio of produced oil within the produced fluid.

The flow control system 25 may further include a controller 54 and corresponding electronics and control logic to control and manage the operation of the components of the flow control system 25. For example, the controller 54 may include control logic to identify changes in rotational speed and adjust the flow of the production fluid 30 through the rotor chamber 44. In some examples, the controller 54 (e.g., including the control logic) may be in communication or coupled between the sensor 48 and the flow regulator 52 to control or actuate the flow regulator 52 based upon the rotational speed of the rotor 46 as measured by the sensor 48. In some examples, the flow regulator 52 may be in fluidic communication with the inlet of an inflow control device. In some examples, the inflow control device may be an electronic inflow control device. In some examples, the controller, using the control logic, may receive the rotational speed of the rotor 46 as measured by the sensor 48 and compare changes in the rotational speed. For example, the controller 54, using the control logic, may detect a change from a first rotational speed to a second rotational speed. In some examples, the change from the first rotational speed to the second rotational speed may indicate a dip in rotational speed which may further indicate the formation of an emulsion as determined by a threshold or a threshold percentage change. In some examples, the formation of an emulsion may indicate a change in the fluid composition of the production fluid where the fluid composition transitions from a first volumetric ratio of two or more fluid components to a second volumetric ratio of two or more fluid components. In some examples, achieving or surpassing the threshold may indicate that the predominant fluid component has transitioned from hydrocarbons (e.g., oil) to water. In other examples, achieving or surpassing the threshold may indicate that the predominant fluid component has transitioned from water to hydrocarbons (e.g., oil). In some examples, the threshold (e.g., associated with the dip in rotational speed) may be a predetermined threshold or threshold percentage change. The threshold may further include a change in excess of a rotational speed threshold that occurs within a threshold time interval. For example, the threshold may include a reduction in rotational speed that is greater than or equal to 10% where the change occurs in a time interval less than or equal to 5 minutes. In some examples, the emulsion phase may be present for a duration less than or equal to 4 minutes, less than or equal to 3 minutes, less than or equal to 2 minutes, less than or equal to 1 minute, less than or equal to 30 seconds, or any combination thereof. Based upon the comparison of the changes in rotational speed with that of the threshold, the controller 54, including the control logic, may then move the flow regulator 52 to adjust the inflow rate of production fluid received into the first flow path 38 of the flow control system 25. The controller 54 may be disposed in the wellbore or at the surface of the well. In some examples, the controller 54 may be disposed on or within the flow control system 25. In further examples, the controller 54 may be disposed on or within the housing 42. In further examples, the controller 54 may be disposed on or within the rotor chamber 44.

Referring still to FIG. 2, the flow control system 25 may include a communications unit (e.g., transmitter or receiver) to send and/or receive communications signals. The communications unit, for example, may be included within the electronics and may be used to receive a communications signal when the flow control system 25 is downhole within a well and/or may be used to send a communications signal up hole or between downhole devices. The flow regulator 52 may control the inflow rate of fluid received into the first flow path 38 based upon the communications signal received by the communications unit. For example, one or more communications signals may be sent from the communications unit to the surface to report properties measured by the flow control system 25 (e.g., telemetry) and/or characteristics of the flow control system 25 (e.g., fluid inflow rate into the flow control system 25). One or more communications may additionally or alternatively be received by the communications unit, such as to facilitate control of one or more components of the flow control system 25.

A communications signal may be received by the communications unit to control the inflow rate of the production fluid received into the first flow path 38 of the flow control system 25, such as to increase or decrease the fluid inflow rate into or through the flow control system 25. Communication signals may be used to indicate that the well is in a preliminary phase, intermediate phase, or final phase, in which different control parameters may be used for each of these different phases of the well. Additionally, different thresholds may be used depending on the phase of the well in which the well is producing. Further, communication signals may be used to confirm that the flow control system 25 is working properly and/or confirm downhole conditions of the well. A communication unit may include one or more sensors for telemetry, such as an accelerometer, a gyroscope, and/or a hydrophone. A communication unit may also be capable of use with mud-pulse telemetry, pressure profile telemetry, flow rate telemetry, acoustic pulse telemetry, and/or pseudo-static pressure profile telemetry.

Figure 3:
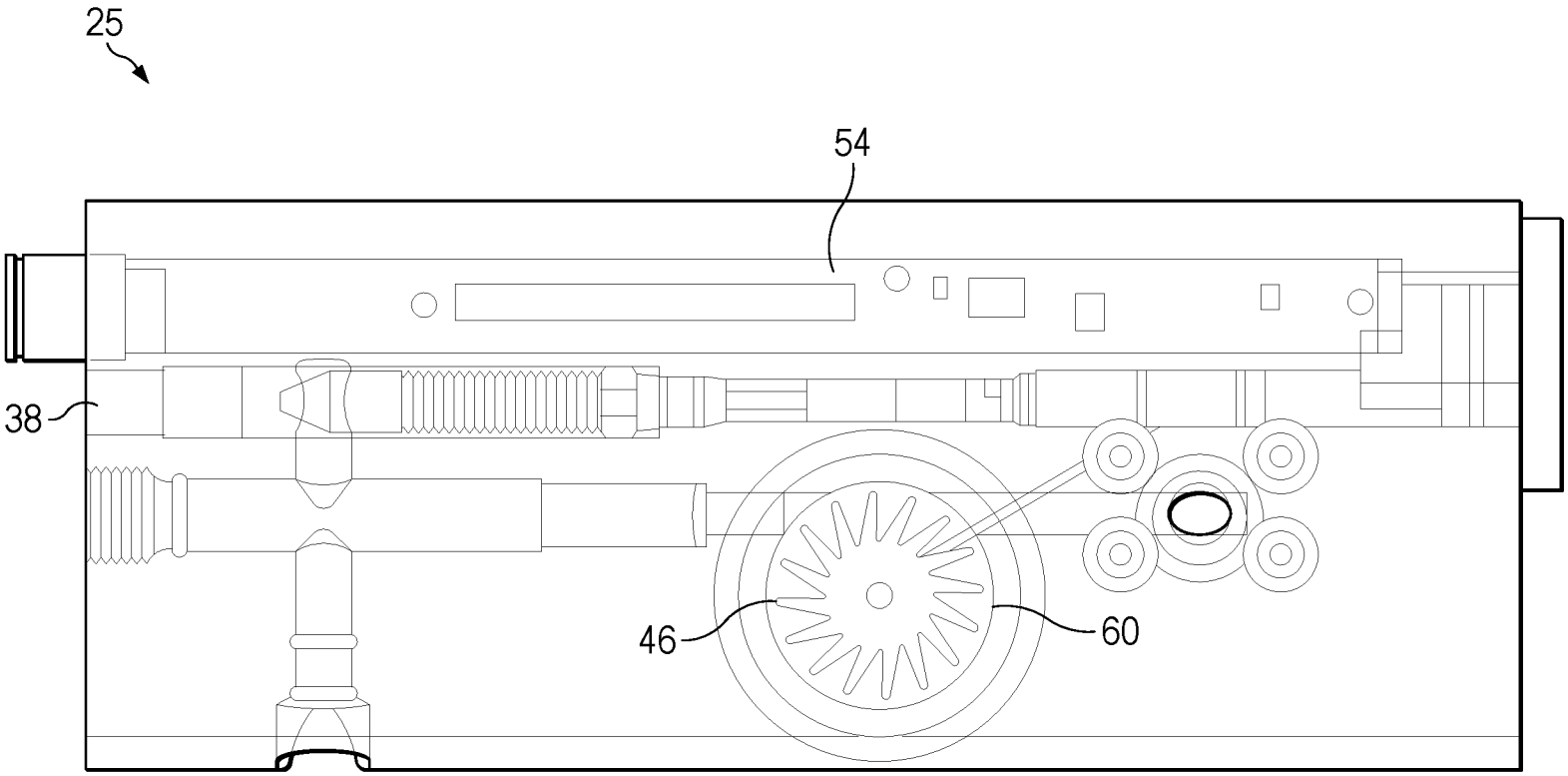
FIG. 3 illustrates a detailed view of a variable flow resistance system in accordance with one or more embodiments of the present disclosure.

FIG. 3 shows a detailed view of a flow control system 25 in accordance with one or more embodiments of the present disclosure. The flow control system 25 in FIG. 3 may be an alternative embodiment to the flow control system 25 in FIG. 2, in which like features have like reference numbers. In FIG. 3, the power generator 60 may include the rotor 46 or a turbine and may be able to generate power (e.g., electrical power) from fluid received into the first flow path 38 and flowing through the flow control system 25. In one or more embodiments, the power generator 60 may include a power storage device. The power generator 60 may be an electrical generator. The power generator 60 may be used to generate power (e.g., electrical power) for the flow control system 25, and the power storage device may be used to store power for the flow control system 25 and/or store power (e.g., electrical power) generated by the power generator 60. In some examples, the rotor 46 may be a component of the power generator 60 (e.g., electrical power generator). For example, the rotor 46 may be a turbine which rotates to generate power which may be stored in the power storage component of power generator 60. In some examples, the power generator and the flow regulator 52 may be in series such that the production fluid 30 does not flow through the power generator 60 when the flow regulator 52 is closed. The power generator 60 may additionally or alternatively include other types of power generators, such as a flow induced vibration power generator and/or a piezoelectric generator, to generate power from the fluid received into the flow control system 25 and/or from other energy sources present downhole (e.g., temperature and/or pressure sources).

The power storage device, for example, may be included within the electronics within controller 54 and may be used to store power, such as power generated by the power generator 60. The power storage device may include a capacitor (e.g., super capacitor), battery (e.g., rechargeable battery), and/or any other type of power storage device known in the art. In one or more embodiments, as the sensor(s) and/or actuator(s) of the flow control system 25 may require more power than generated by the power generator 60, the power storage device may be used to store power, and then supplement the power generator 60 when running the sensor(s), actuator(s), and/or other components of the flow control system 25.

Figure 4:
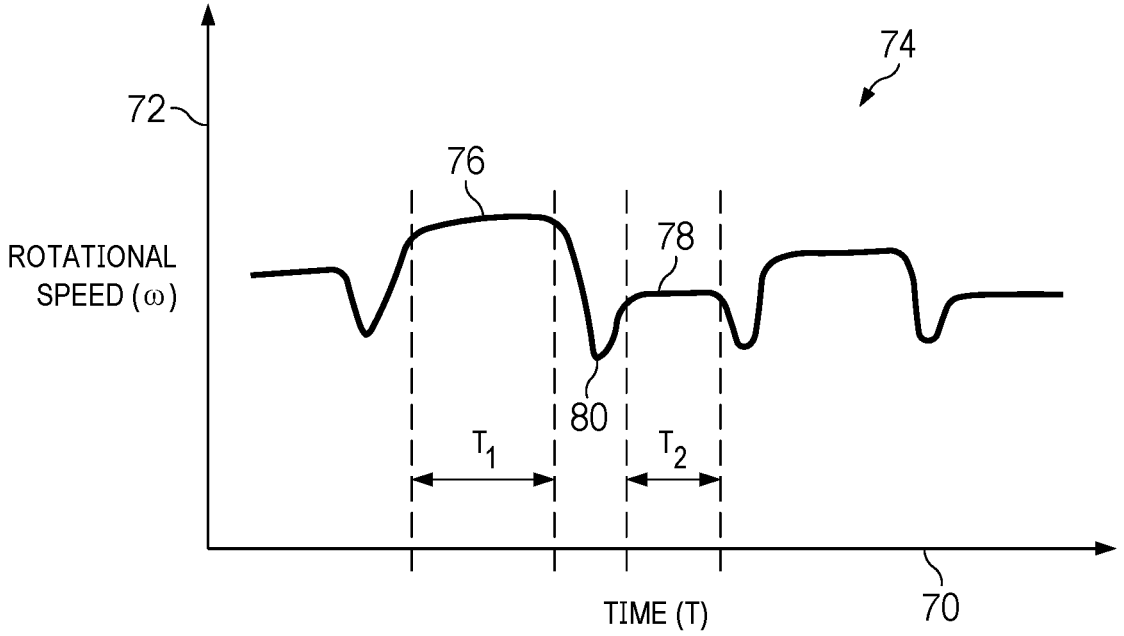
FIG. 4 depicts a plot of rotational speeds of a rotor measured by a sensor in response to different compositions of production fluids.

FIG. 4 is a graph depicting an example of how a rotational speed (ω) may vary over time (T) in response to a varying composition of production fluid through a rotor chamber. For instance, in reference to the example configuration of FIG. 3, the rotational speed ω of the rotor 46 may be sensed by the sensor 48 in the form of an output voltage that varies with rotational speed ω, e.g., in revolutions per minute ("RPM"). The variation in rotational speed plotted in FIG. 4 is at least partially due to a variation in fluid composition, such as a change in fluid components or a volumetric ratio thereof in the production fluid. The variation in rotational speed is further due to a phase behavior of the production fluid, such as the creation of a temporary emulsion of two or more fluid components as the fluid composition transitions.

In this example, time T is plotted on the horizontal axis 70 and rotational speed is plotted on the vertical axis 72. Different regions 74 are identified in the graph that evidence a variation in a fluid composition of the production fluid over time. These include two regions 76, 78 identified in the graph at which a fluid composition of the production fluid is at relative steady state, with no appreciable emulsion phase present in the flow. For example, the first region 76 may represent a first set of measurements taken while a production fluid having a first composition of one or more fluid components (e.g., oil, water, and/or gas) is passed through a rotor chamber to rotate the rotor (e.g., rotor 46 in FIG. 2) or turbine. A second region 78 may represent a second set of measurements taken while the production fluid has a second fluid composition, including either a different set of fluid components or a different ratio thereof.

The first fluid composition and the second fluid composition may have different volumetric ratios of fluid components. Thus, the fluid compositions may exhibit different viscosities, and therefore different rotational speeds in the first and second regions 76, 78. The fluid compositions within each of these first and second regions 76, 78 may be fairly constant, and thus, the rotational speed ω may be fairly constant during the respective time periods $T_1$, $T_2$. Thus, if the first and second fluid compositions are significantly different, the transition from the first fluid composition to the second fluid composition may be evidenced by a change in the rotational speed ω from the first region 76 to the second region 78 of the graph.

In other cases, the difference in rotational speed ω at two different fluid compositions may be less pronounced, or additional information may otherwise be helpful from the rotational response of the rotor to confirm that the fluid composition has transitioned or that a transition (e.g., a sudden increase in water production) is about to occur. In at least some cases, the transition may be additionally detectable or confirmed as an anomaly in the time-varying RPM data due to an emulsion formed between two fluid components during transition. The non-Newtonian behavior of the emulsion makes the presence of the emulsion easily detectable in a rotor chamber, resulting in an RPM response other than just a gradual transition along intermediate RPM values between first and second rotational speeds at two different steady-state fluid compositions.

For example, with continued reference to FIG. 4, a pronounced dip 80 in rotational speed ω occurs during the transition from the first region 76 to the second region 78 called out in the graph. The dip 80 in rotational speed may be associated with an emulsion formed from a transition in the fluid composition of the production fluid. For example, an emulsion may form when the volumetric ratio of the production fluid transitions from oil-dominant to water-dominant. In other examples, an emulsion may form when the volumetric ratio of the production fluid transitions from water-dominant to oil-dominant. In some examples, achieving or surpassing a threshold may indicate that the predominant fluid component has transitioned from hydrocarbons (e.g., oil) to water. In other examples, achieving or surpassing the threshold may indicate that the predominant fluid component has transitioned from water to hydrocarbons (e.g., oil). In some examples, the threshold (e.g., associated with the dip in rotational speed) may be a predetermined threshold. The threshold may further include a change in excess of a rotational speed threshold that occurs within a threshold time interval. For example, the threshold may include a reduction in rotational speed that is greater than or equal to 10% where the change occurs in a time interval less than or equal to 5 minutes. In some examples, the time interval for the emulsion phase may be a duration less than or equal to 4 minutes, less than or equal to 3 minutes, less than or equal to 2 minutes, less than or equal to 1 minute, less than or equal to 30 seconds, or any combination thereof.

Figure 5:
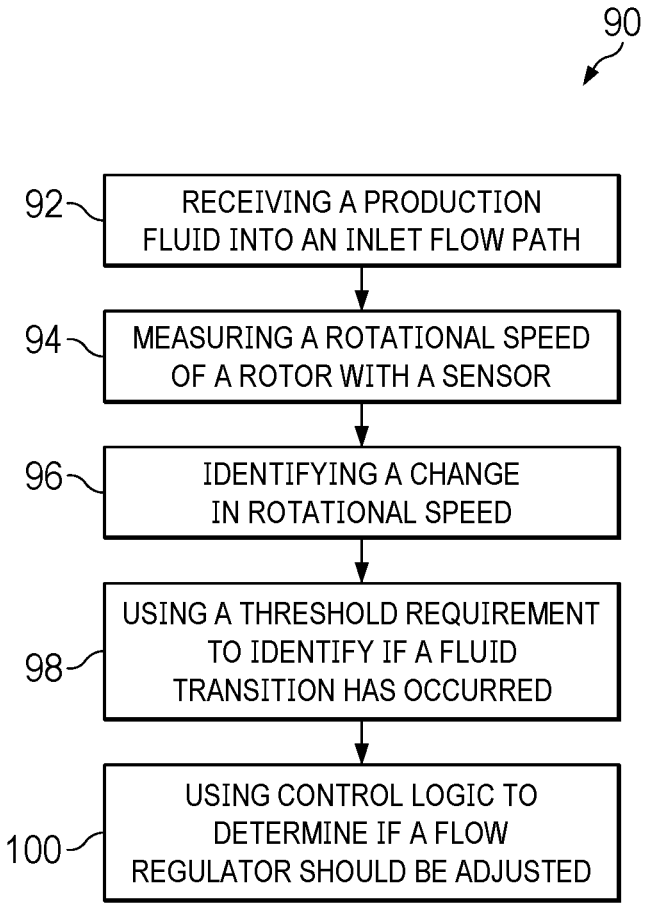
FIG. 5 depicts a flowchart for determining whether a flow regulator should be adjusted.

FIG. 5 depicts a flowchart 90 for determining whether a flow regulator should be adjusted or actuated. In block 92, at least a portion of a production fluid is received into an inlet flow path of a flow control system where it passes through a rotor chamber and rotates a rotor or a turbine. In block 94, a sensor may measure the rotational speed of the rotor or turbine as the production fluid passes through the rotor chamber. The rotational speed measured by the sensor may vary as a function of the viscosity of the production fluid. In block 96, a controller (e.g., controller 54 in FIG. 2), which may include control logic, may be used to detect a change in the rotational speed of the rotor (e.g., rotor 46 in FIG. 2) or turbine. In block 98, the controller which may include control logic may be used to identify whether a threshold associated with a fluid transition has been reached. For example, the threshold may be used to identify a dip in the rotational speed which may further be associated with an emulsion formed when a transition in fluid composition occurs. In block 100, the controller which may include control logic may be used to determine if a flow regulator should be adjusted or actuated based on the identification of a transition in fluid composition.

Accordingly, the present disclosure may provide devices, systems, and methods that may relate to the production of fluids from subterranean formations. The methods/systems/compositions/tools may include any of the various features disclosed herein, including one or more of the following statements.

Statement 1. A downhole flow system comprising: a housing positionable in a well; a flow control device for controlling a flow of production fluid through the housing into a production conduit; a rotor chamber defined within the housing, wherein a portion of the flow is routed through the rotor chamber; a rotor disposed in the rotor chamber and rotatable in response to the portion of the flow through the rotor chamber; and a controller in communication with the flow control device having control logic to detect a variation in a rotational speed resulting from a transition in a fluid composition of the production fluid and to adjust the flow of the production fluid through the housing in response thereto.

Statement 2. The system of statement 1, further comprising a first flow path through the rotor chamber and a second flow path bypassing the rotor chamber, wherein the controller adjusts the flow of the production fluid through the second flow path in response to the variation in the rotational speed.

Statement 3. The system of statement 1 or 2, wherein the transition in the fluid composition comprises one or both of a change in fluid components and a change in a volumetric ratio of the fluid components of the production fluid.

Statement 4. The system of any of the preceding statements, wherein the controller detects the transition as a change in the rotational speed from a first rotational speed at a first fluid composition to a second rotational speed at a second fluid composition.

Statement 5. The system of statement 4, wherein the controller detects the transition as a dip below the first or second rotational speed during the transition, resulting from an emulsion between two or more fluid components.

Statement 6. The system of statement 5, wherein the fluid components comprise oil and water and the emulsion is an emulsion of the oil and water.

Statement 7. The system of statement 5, wherein the dip in rotational speed due to an emulsion corresponds to an increased viscosity of the emulsion relative to the viscosity of the separate fluid components.

Statement 8. The system of statement 4, wherein detecting the change from the first rotational speed to the second rotational speed comprises detecting a change in excess of a rotational speed threshold that occurs within a threshold time interval.

Statement 9. The system of statement 8, wherein the rotational speed threshold is greater than or equal to 10% and the threshold time interval is less than or equal to 5 minutes.

Statement 10. The system of any of the preceding statements, wherein the controller further comprises control logic for detecting a plurality of the transitions in the fluid composition of the production fluid over a time period and computing the volumetric ratio of two or more of the fluid components over the time period.

Statement 11. The system of any of the preceding statements, further comprising an electrical generator coupled with the rotor to generate electrical power from rotation of the rotor.

Statement 12. The system of any of the preceding statements, wherein the downhole flow control device comprises an inflow control device including a flow regulator in fluidic communication with an inlet of the electronic inflow control device and adjustable to provide a flow resistance to the production fluid flowing through the electronic inflow control device, wherein the controller is configured to actuate the flow regulator to change the flow resistance through the electronic inflow control device, and an electrical generator in fluidic communication with the inlet that utilizes the production fluid flowing through the electronic inflow control device to generate electrical power, wherein the electrical generator and the flow regulator are in parallel.

Statement 13. A method for controlling production of a production fluid in a well, comprising: directing a flow of the production fluid through a housing into a production conduit; directing at least a portion of the flow of the production fluid through a rotor chamber disposed in a subterranean portion of the well to rotate a rotor disposed in the rotor chamber; detecting a transition in a fluid composition of the production fluid based on a variation in a rotational speed of the rotor; and adjusting the flow of the production fluid in response to the detected transition.

Statement 14. The method of statement 13, wherein the transition in the fluid composition of the production fluid further comprises a change in fluid components or a volumetric ratio of the fluid components of the production flow.

Statement 15. The method of statement 14, wherein adjusting the flow of the production fluid comprises adjusting the flow through the housing along a flow path bypassing the rotor chamber.

Statement 16. The method of statement 15, wherein detecting the transition comprises detecting a change in the rotational speed from a first rotational speed at a first fluid composition to a second rotational speed at a second fluid composition.

Statement 17. The method of statement 16, wherein detecting the transition further comprises detecting a dip below the first or second rotational speed during the transition, resulting from an emulsion between two or more fluid components.

Statement 18. The method of any one of statements 13 through 17, further comprising identifying a phase change using a threshold percentage change in revolutions per minute (RPM) within a threshold time interval, wherein the threshold percentage change is greater than or equal to 10% and the threshold time interval is less than or equal to 5 minutes.

Statement 19. The method of any one of statements 13 through 18, further comprising detecting multiple transitions in the fluid composition of the production fluid over a time period and computing a volumetric ratio of the two or more fluid components over the time period.

Statement 20. The method of any one of statements 13 through 19, further comprising adjusting an inflow control device wherein the inflow control device is adjustable to provide a flow resistance to the production fluids through the inflow control device.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A downhole flow control system, comprising:

a housing positionable in a well;

a flow control device for controlling a flow of production fluid through the housing into a production conduit;

a rotor chamber defined within the housing, wherein a portion of the flow is routed through the rotor chamber;

a rotor disposed in the rotor chamber and rotatable in response to the portion of the flow through the rotor chamber; and a controller in communication with the flow control device having control logic to detect a variation in a rotational speed resulting from a transition in a fluid composition of the production fluid and to adjust the flow of the production fluid through the housing in response thereto, further comprising identifying a phase change using a threshold percentage change in revolutions per minute (RPM) within a threshold time interval, wherein the threshold percentage change is greater than or equal to 10% and the threshold time interval is less than or equal to 5 minutes.

2. The downhole flow control system of claim 1, further comprising a first flow path through the rotor chamber and a second flow path bypassing the rotor chamber, wherein the controller adjusts the flow of the production fluid through the second flow path in response to the variation in the rotational speed.

3. The downhole flow control system of claim 1, wherein the transition in the fluid composition comprises one or both of a change in fluid components and a change in a volumetric ratio of the fluid components of the production fluid.

4. The downhole flow control system of claim 1, wherein the controller detects the transition as a change in the rotational speed from a first rotational speed at a first fluid composition to a second rotational speed at a second fluid composition.

5. The downhole flow control system of claim 4, wherein the controller detects the transition as a dip below the first or second rotational speed during the transition, resulting from an emulsion between two or more fluid components.

6. The downhole flow control system of claim 5, wherein the fluid components comprise oil and water and the emulsion is an emulsion of the oil and water.

7. The downhole flow control system of claim 5, wherein the dip in rotational speed due to an emulsion corresponds to an increased viscosity of the emulsion relative to the viscosity of the separate fluid components.

8. The downhole flow control system of claim 4, wherein detecting the change from the first rotational speed to the second rotational speed comprises detecting a change in excess of a rotational speed threshold that occurs within a threshold time interval.

9. The downhole flow control system of claim 8, wherein the rotational speed threshold is greater than or equal to 10% and the threshold time interval is less than or equal to 5 minutes.

10. The downhole flow control system of claim 1, wherein the controller further comprises control logic for detecting a plurality of the transitions in the fluid composition of the production fluid over a time period and computing a volumetric ratio of two or more of the fluid components over the time period.

11. The downhole flow control system of claim 1, further comprising an electrical generator coupled with the rotor to generate electrical power from rotation of the rotor.

12. The downhole flow control system of claim 1, wherein the flow control device comprises an inflow control device including a flow regulator in fluidic communication with an inlet of the electronic inflow control device and adjustable to provide a flow resistance to the production fluid flowing through the electronic inflow control device, wherein the controller is configured to actuate the flow regulator to change the flow resistance through the electronic inflow control device, and an electrical generator in fluidic communication with the inlet that utilizes the production fluid flowing through the electronic inflow control device to generate electrical power, wherein the electrical generator and the flow regulator are in parallel.

13. A method for controlling production of a production fluid in a well, comprising:

directing a flow of the production fluid through a housing into a production conduit;

directing at least a portion of the flow of the production fluid through a rotor chamber disposed in a subterranean portion of the well to rotate a rotor disposed in the rotor chamber;

detecting a transition in a fluid composition of the production fluid based on a variation in a rotational speed of the rotor;

identifying a phase change using a threshold percentage change in revolutions per minute (RPM) within a threshold time interval, wherein the threshold percentage change is greater than or equal to 10% and the threshold time interval is less than or equal to 5 minutes; and adjusting the flow of the production fluid in response to the detected transition.

14. The method of claim 13, wherein the transition in the fluid composition of the production fluid further comprises a change in fluid components or a volumetric ratio of the fluid components of the production flow.

15. The method of claim 14, wherein adjusting the flow of the production fluid comprises adjusting the flow through the housing along a flow path bypassing the rotor chamber.

16. The method of claim 15, wherein detecting the transition comprises detecting a change in the rotational speed from a first rotational speed at a first fluid composition to a second rotational speed at a second fluid composition.

17. The method of claim 16, wherein detecting the transition further comprises detecting a dip below the first or second rotational speed during the transition, resulting from an emulsion between two or more fluid components.

18. The method of claim 13, further comprising detecting multiple transitions in the fluid composition of the production fluid over a time period and computing a volumetric ratio of the two or more fluid components over the time period.

19. The method of claim 13, further comprising adjusting an inflow control device wherein the inflow control device is adjustable to provide a flow resistance to the production fluids through the inflow control device.

* * * * *